US012403945B2

(12) United States Patent
Liu et al.

(10) Patent No.: US 12,403,945 B2
(45) Date of Patent: Sep. 2, 2025

(54) METHOD AND SYSTEM FOR VIRTUALLY COUPLED TRAIN SET CONTROL

(71) Applicant: BEIJING JIAOTONG UNIVERSITY, Beijing (CN)

(72) Inventors: Hongjie Liu, Beijing (CN); Xiaolin Luo, Beijing (CN); Tao Tang, Beijing (CN); Ming Chai, Beijing (CN); Shuai Su, Beijing (CN); Jidong Lv, Beijing (CN)

(73) Assignee: BEIJING JIAOTONG UNIVERSITY, Beijing (CN)

( * ) Notice: Subject to any disclaimer, the term of this patent is extended or adjusted under 35 U.S.C. 154(b) by 74 days.

(21) Appl. No.: 18/392,173

(22) Filed: Dec. 21, 2023

(65) Prior Publication Data

US 2024/0400119 A1 Dec. 5, 2024

(30) Foreign Application Priority Data

May 23, 2023 (CN) ..... 202310590156.9

(51) Int. Cl.
*B61L 27/16* (2022.01)
*B61L 25/02* (2006.01)
*B61L 27/10* (2022.01)

(52) U.S. Cl.
CPC ..... *B61L 27/16* (2022.01); *B61L 25/021* (2013.01); *B61L 27/10* (2022.01)

(58) Field of Classification Search
CPC ..... B61L 27/16; B61L 25/01; B61L 25/02; B61L 25/025; B61L 25/026; B61L 25/028; B61L 27/10; B61L 27/12; B61L 27/14
See application file for complete search history.

(56) References Cited

U.S. PATENT DOCUMENTS 10,259,478 B1 * 4/2019 Gao ..... B61L 27/20
2004/0088104 A1 * 5/2004 Izbicki ..... G08G 1/123 340/994
2022/0277237 A1 * 9/2022 Su ..... G06Q 10/06312
2023/0311959 A1 * 10/2023 Chai ..... B61L 23/34 701/19

* cited by examiner

*Primary Examiner* — Jacob M Amick
(74) *Attorney, Agent, or Firm* — Schmeiser, Olsen & Watts LLP

(57) ABSTRACT

A method and system for virtually coupled train set (VCTS) control is provided. The method includes following steps: determining whether to execute a backup control strategy based on an actual state for a current cycle of each train unit and a target state sequence for a first preset number of cycles before the current cycle to obtain a first determination result; if the first determination result is yes, executing the backup control strategy to control each train unit; if the first determination result is no, calculating the target state sequence for the current cycle of each train unit according to a position or calculating the target state sequence for the current cycle of each train unit by using a synchronization relationship; and controlling each train unit according to the target state sequence for the current cycle of each train unit, respectively.

20 Claims, 6 Drawing Sheets

METHOD AND SYSTEM FOR VIRTUALLY COUPLED TRAIN SET CONTROL

CROSS-REFERENCE TO RELATED APPLICATION

This application claims priority to Chinese Application No. 2023105901569, having a filing date of May 23, 2023, the entire contents of which are hereby incorporated by reference.

FIELD OF TECHNOLOGY

The following relates to the technical field of rail transit signals and control, in particular to a method and a system for virtually coupled train set (VCTS) control.

BACKGROUND

The construction of urban rail transit (URT) has achieved remarkable results in recent years. With the rapid development of the network scale of URT, the spatial and temporal distribution of passenger flow is unbalanced, and the characteristics of irregular dynamic change are increasingly prominent. The virtual coupling technology is a widely recognized solution to solve the problems resulting from this characteristic in URT operations.

The virtual coupling technology can join multiple train units as a VCTS without physical couplers and greatly shorten the following distance between these train units, so that a VCTS can provide transportation services the same way as a physically coupled train. The virtual coupling technology can adjust the train formations dynamically, thus improving the utilization efficiency of train units and line resources. This can not only meet the demand for high capacity provided for passengers during peak hours, but also reduce the empty-loaded rate of train units during flat and off-peak hours. Therefore, the virtual coupling technology can reduce the energy consumption of train operation and save the transportation cost without reducing the service quality, which is of great significance to the green and sustainable development of URT.

In most existing studies, the control framework to realize the operation of VCTS is as follows. A leading train unit tracks a recommended driving curve, and following train units adjust themselves according to the real-time state of their preceding train units, so as to keep an expected following distance with the preceding train unit. In order to ensure safety for VCTS operation, the following distance should be kept greater than a safety protection distance. However, the actual safety protection distance is high-order and nonlinear w.r.t. the states of two successive units, and it is difficult for the following train unit to directly deal with a complex distance in real-time control. Therefore, a conservative and simplified objective for following distance is usually used. This practice increases the following distance between adjacent train units, and will also lead to the problems of unsynchronized train arrivals and a large time interval between the train units stopping at a station.

In order to solve the above problems, some studies have proposed that all train units in VCTS track their recommended driving curves to maintain a desired following distance. The recommended driving curve of each train unit consists of a time-discrete sequence of position, speed and acceleration. When all the train units in VCTS operate according to the recommended curve on time, the train units can reach the target station and stop synchronously, keeping a small time interval between arrivals.

However, due to inevitable problems such as departure delay and tracking error accumulation, the existing methods cannot guarantee that all train units can keep their synchronous operation relationship while tracking their recommended driving curves, which will seriously affect the operation performance of VCTS, leading to unexpected situations such as a large time interval between the arrivals of train units in VCTS or emergency braking triggered by overspeed during operation.

SUMMARY

An aspect relates to a method and a system for VCTS control, so as to ensure that a synchronous operation relationship between all train units can be maintained while tracking their respective recommended driving curves.

To achieve the above aspect, the present disclosure provides the following solution.

The present disclosure provides a method for VCTS control, including:

- acquiring an actual state for a current cycle of each train unit in VCTS;
- determining whether to execute a backup control strategy based on the actual state for the current cycle of each train unit and a target state sequence for a first preset number of cycles before the current cycle, to obtain a first determination result; where the backup control strategy includes a control strategy for tracking a recommended driving curve by a first train unit and a control strategy for tracking a i-th train unit by a (i+1)-th train unit, where a value of i is greater than or equal to 1;
- executing the backup control strategy to control each train unit, if the first determination result is yes;
- executing following operations, if the first determination result is no:
- determining whether synchronization of each train unit in the VCTS meets a preset condition, to obtain a second determination result;
- calculating a target state sequence for the current cycle of each train unit based on a position according to the actual state for the current cycle of each train unit, if the second determination result is yes;
- calculating the target state sequence for the current cycle of each train unit by using a synchronization relationship according to the actual state for the current cycle of each train unit, if the second determination result is no;
- controlling each train unit according to the target state sequence for the current cycle of each train unit, respectively.

In some embodiments, the determining whether to execute a backup control strategy based on the actual state for the current cycle of each train unit and a target state sequence for a first preset number of cycles before the current cycle to obtain a first determination result includes:

- determining whether a flag bit of a first cycle before the current cycle is displayed normally, to obtain a third determination result;
- determining whether a difference between an actual speed for the current cycle of each train unit and a first target speed in a target state sequence for n cycles before the current cycle is less than a speed difference threshold, if the third determination result is yes; where if the difference between the actual speed for the current cycle of each train unit and the first target speed in the target state sequence for the n cycles before the current cycle is less than the speed difference threshold, the first determination result is yes, and a flag bit of the current cycle is set as normal; otherwise, the first determination result is no, and the flag bit of the current cycle is set as abnormal;

determining whether a difference between the actual speed for the current cycle of each train unit and a first target speed in a target state sequence for m cycles before the current cycle is less than the speed difference threshold, if the third determination result is no; where if the difference between the actual speed for the current cycle of each train unit and the first target speed in the target state sequence for the m cycles before the current cycle is less than the speed difference threshold, the first determination result is yes, and the flag bit of the current cycle is set as normal; otherwise, the first determination result is no, and the flag bit of the current cycle is set as abnormal, where n and m are values of the first preset number in different situations, and m≥n.

In some embodiments, the determining whether synchronization of each train unit in the VCTS meets a preset condition to obtain a second determination result includes:

confirming that the second determination result is yes when time index deviations between any two adjacent train units in the VCTS are all less than a time index deviation threshold;

confirming that the second determination result is no when the time index deviations between any two adjacent train units in the VCTS are not all less than the time index deviation threshold.

In some embodiments, the calculating a target state sequence for the current cycle of each train unit based on a position according to the actual state for the current cycle of each train unit includes:

determining, according to an actual position and an actual speed for the current cycle of each train unit, an initial target state as: $\bar{s}_{i,0|k}=s_{i,k}$, $\bar{v}_{i,0|k}=V(\bar{s}_{i,0|k})$, i=1, 2, 3, . . . , I;

where $\bar{s}_{i,0|k}$ is an initial target position in a target state sequence for the current cycle of the i-th train unit, $\bar{v}_{i,0|k}$ is an initial target speed in the target state sequence for the current cycle of the i-th train unit, $s_{i,k}$ and $v_{i,k}$ are an actual position and an actual speed for the current cycle of the i-th train unit, respectively, V( ) is a calculation function of a target speed, $$V(\bar{s}_{i,0|k}) = \hat{v}_{i,q} + \frac{(\bar{s}_{i,0|k} - \hat{s}_{i,q})(\hat{v}_{i,q+1} - \hat{v}_{i,q})}{\hat{s}_{i,q+1} - \hat{s}_{i,q}}, \text{ s.t. } \hat{s}_{i,q} \le \bar{s}_{i,0|k} < \hat{s}_{i,q+1},$$

$\hat{s}_{i,q}$ and $\hat{s}_{i,q+1}$ represent q-th and (q+1)-th recommended position values on a recommended driving curve of the i-th train unit, respectively, $\hat{v}_{i,q}$ and $\hat{v}_{i,q+1}$ represent q-th and (q+1)-th recommended speed values on the recommended driving curve of the i-th train unit, respectively, and I is the number of train units in the VCTS;

calculating, based on the initial target position and the initial target speed, a target position and a target speed in the target state sequence for the current cycle of each train unit based on following formulas:

$$\bar{s}_{i,j+1|k} = \bar{s}_{i,j|k} + \tau\bar{v}_{i,j|k},\ j = 0, 1, \ldots, N-1$$

$$\bar{v}_{i,j+1|k} = V(\bar{s}_{i,j+1|k})$$

where $\bar{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, N is a number of target states in the target state sequence, τ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{i,p})}{\hat{s}_{i,p+1} - \hat{s}_{i,p}}, \text{ s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively;

performing differential calculation on the target speed in the target state sequence for the current cycle of each train unit to obtain a target acceleration in the target state sequence for the current cycle of each train unit.

In some embodiments, the calculating the target state sequence for the current cycle of each train unit by using a synchronization relationship according to the actual state for the current cycle of each train unit includes:

determining, according to an actual position and an actual speed for the current cycle of each train unit, an initial target state of each train unit as: $\bar{s}_{i,0|k}=s_{i,k}$, $\bar{v}_{1,0|k}=V(\bar{s}_{1,0|k})$, $\bar{v}_{i,0|k}=V(\bar{s}_{i',0|k})+v_a(0)$, i'=2, 3, . . . , I;

where $\bar{s}_{i,0|k}$ is an initial target position in a target state sequence for the current cycle of the i-th train unit, $s_{i,k}$ is an actual position for the current cycle of the i-th train unit, $\bar{v}_{1,0|k}$ and $\bar{v}_{i',0|k}$ are initial target speeds in target state sequences for the current cycle of the first train unit and a i'-th train unit, respectively, $v_a(0)$ is an adjustment amount of the initial target speed in the target state sequence for the current cycle of the i-th train unit, V( ) is a calculation function of a target speed, $$V(\bar{s}_{i,0|k}) = \hat{v}_{i,q} + \frac{(\bar{s}_{i,0|k} - \hat{s}_{i,q})(\hat{v}_{i,q+1} - \hat{v}_{i,q})}{\hat{s}_{i,q+1} - \hat{s}_{i,q}}, \text{ s.t. } \hat{s}_{i,q} \le \bar{s}_{i,0|k} < \hat{s}_{i,q+1},,$$

$\hat{s}_{i,q}$ and $\hat{s}_{i,q+1}$ represent q-th and (q+1)-th recommended position values on the recommended driving curve of the i-th train unit, respectively, $\hat{v}_{i,q}$ and $\hat{v}_{i,q+1}$ represent q-th and (q+1)-th recommended speed values on the recommended driving curve of the i-th train unit, respectively, and I is a number of train units;

calculating, based on the initial target state, a target position and a target speed in the target state sequence for the current cycle of each train unit based on following formulas:

$$\bar{s}_{i,j+1|k} = \bar{s}_{i,j|k} + \tau\bar{v}_{i,j|k},\ j = 0, 1, \ldots, N-1$$

$$\bar{v}_{i,j+1|k} = V(\bar{s}_{i,j+1|k}) + v_a(j)$$

where $\bar{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, $\tau$ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{i,p})}{\hat{s}_{i,p+1} - \hat{s}_{i,p}} \text{ s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively, and $v_a(j)$ is an adjustment amount of the j-th target speed in the target state sequence;

performing differential calculation on the target speed in the target state sequence for the current cycle of each train unit to obtain a target acceleration in the target state sequence for the current cycle of each train unit.

In some embodiments, a calculation formula of the adjustment amount of the j-th target speed in the target state sequence is:

$$v_a(j) = \begin{cases} (c_a + j)a_a\tau, & (c_a + j) \le \Delta v_a/a_a/\tau \\ \Delta v_a, & \Delta v_a/a_a/\tau \le (c_a + j) \le T_a/\tau - \Delta v_a/a_a/\tau \\ (T_a/\tau - (c_a + j))a_a & (c_a + j) \ge T_a/\tau - \Delta v_a/a_a/\tau \\ 0 & \text{else} \end{cases}$$

where $c_a$ is a number of cycles between the current cycle and a cycle during which adjustment is performed based on the adjustment amount for a first time, $a_a$ is a preset adjustment acceleration, $\tau$ is the sampling interval time, $\Delta v_a$ is a maximum adjustment speed, and $T_a$ is a preset adjustment time.

In some embodiments, prior to controlling each train unit according to the target state sequence for the current cycle of each train unit, the method further includes:

executing following operations, when a difference between an actual speed and an emergency braking intervention (EBI) speed for a second preset number of cycles between a previous moment and the current cycle of each train unit does not meet a preset condition:

adjusting a target speed and a target position in the target state sequence for the current cycle of each train unit based on following formulas:

$$\bar{v}'_{i,j|k} = \bar{v}_{i,j|k} - k_e\Delta v_e$$

$$\bar{s}'_{i,j+1|k} = \bar{s}'_{i,j|k} + \tau\bar{v}'_{i,j|k}$$

$$\Delta v_e = \frac{1}{l}\sum_{l=k-n+1}^{k} v_{i,l} - \bar{v}_{i,ebi} + v_e$$

where $\bar{v}'_{i,j|k}$ is a j-th adjusted target speed in the target state sequence for the current cycle of the i-th train unit, $\bar{s}'_{i,j|k}$ and $\bar{s}'_{i,j+1|k}$ are j-th and (j+1)-th adjusted target positions in the target state sequence for the current cycle of the i-th train unit, respectively, $\bar{v}_{i,j|k}$ is a j-th target speed in the target state sequence for the current cycle of the i-th train unit, $k_e$ is a compensation proportional coefficient, $\tau$ is a sampling interval time, $\Delta v_e$ is a speed compensation amount, $v_{i,l}$ is an actual speed at a l-th moment before the current cycle, l−1 is a second preset number, $\bar{v}_{i,ebi}$ is an EBI speed of the i-th train unit, and $v_e$ is an EBI speed margin value;

performing differential calculation on an adjusted target speed in the target state sequence for the current cycle of each train unit to obtain an adjusted target acceleration in the target state sequence for the current cycle of each train unit.

The present disclosure provides a system for VCTS control, where the system is applied to the method described above, and the system includes:

a state acquiring module, configured to acquire an actual state of a current cycle of each train unit in VCTS;

a first determination module, configured to determine whether to execute a backup control strategy based on the actual state for the current cycle of each train unit and a target state sequence for a first preset number of cycles before the current cycle, to obtain a first determination result; where the backup control strategy includes a control strategy for tracking a recommended driving curve by a first train unit and a control strategy for tracking a i-th train unit by a (i+1)-th train unit, where a value of i is greater than or equal to 1;

a first control module, configured to execute the backup control strategy to control each train unit, if the first determination result is yes;

a second determination module, configured to determine whether synchronization of each train unit in the VCTS meets a preset condition, to obtain a second determination result, if the first determination result is no;

a first target state sequence calculating module, configured to calculate the target state sequence for the current cycle of each train unit based on a position according to the actual state for the current cycle of each train unit, if the second determination result is yes;

a second state sequence calculating module, configured to calculate the target state sequence for the current cycle of each train unit by using a synchronization relationship according to the actual state for the current cycle of each train unit, if the second determination result is no;

a second control module, configured to control each train unit according to the target state sequence for the current cycle of each train unit, respectively.

The present disclosure provides an electronic device including a memory, a processor and a computer program product, comprising a computer readable hardware storage device having computer readable program code stored therein, said program code executable by a processor of a computer system to implement a method stored in the memory and executable on the processor, where the processor implements the method described above when executing the computer program.

The present disclosure provides a computer-readable storage medium storing a computer program that is executed to implement the method described above.

According to specific embodiments provided by the present disclosure, the present disclosure discloses the following technical effects.

The embodiment of the present disclosure provides a method and a system for VCTS control. The method includes steps of: acquiring an actual state of a current cycle of each train unit in VCTS; determining whether to execute a backup control strategy based on the actual state for the current cycle of each train unit and a target state sequence for a first preset number of cycles before the current cycle to obtain a first determination result; if the first determination result is yes, executing the backup control strategy to control each train unit; if the first determination result is no, determining whether synchronization of each train unit in VCTS meets a preset condition to obtain a second determination result; if the second determination result is yes, calculating the target state sequence for the current cycle of each train unit based on a position according to the actual state for the current cycle of each train unit; if the second determination result is no, calculating the target state sequence for the current cycle of each train unit by using a synchronization relationship according to the actual state for the current cycle of each train unit; controlling each train unit according to the target state sequence for the current cycle of each train unit, respectively. According to the present disclosure, a control strategy of tracking recommended driving curves is taken as a main control strategy, and the tracking of the target state sequence calculated based on a position or calculated based on a synchronization relationship is taken as a backup control strategy, so as to ensure that a synchronous operation relationship between all train units can be maintained while tracking their respective recommended driving curves.

BRIEF DESCRIPTION

Some of the embodiments will be described in detail, with reference to the following figures, wherein like designations denote like members, wherein.

Figure 6:
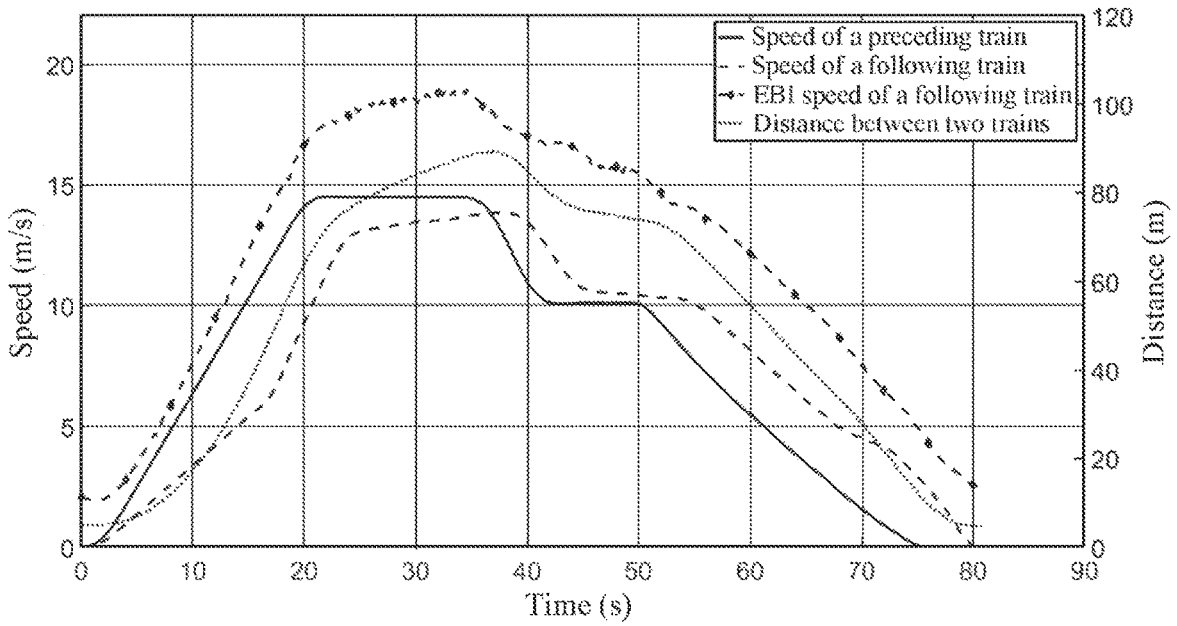
Figure 7:
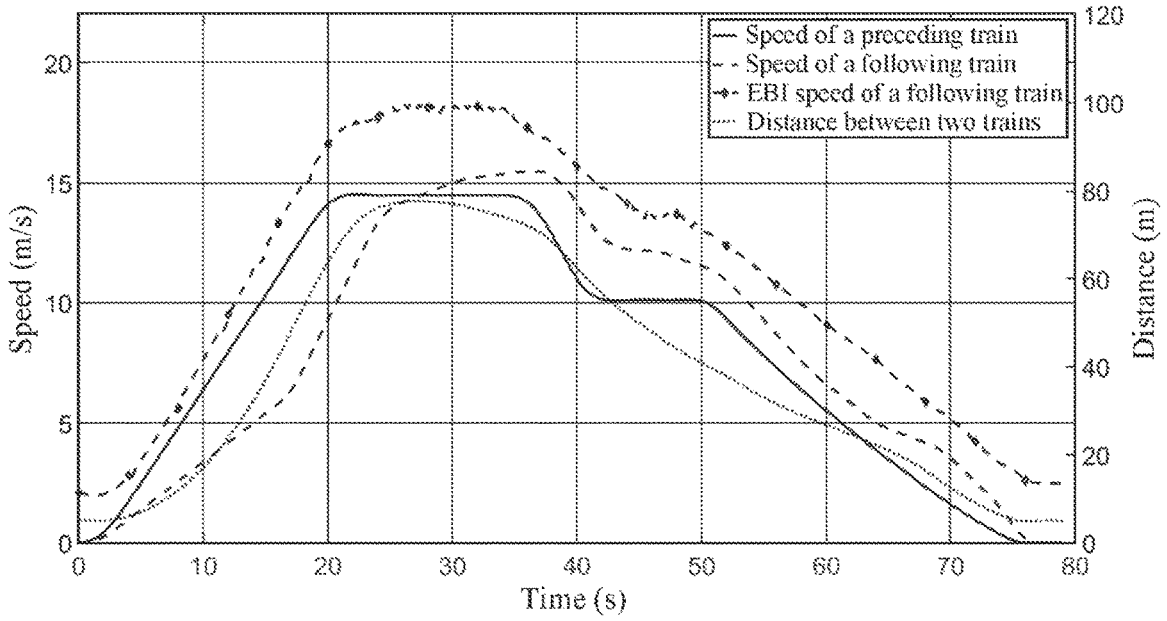
Figure 8:
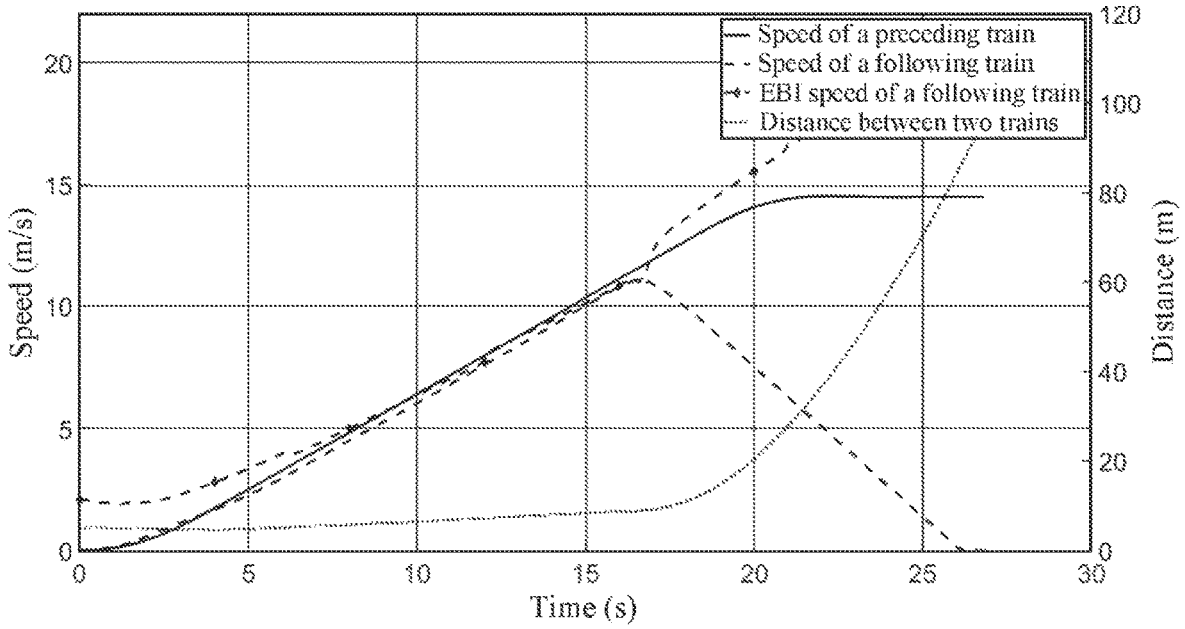
Figure 9:
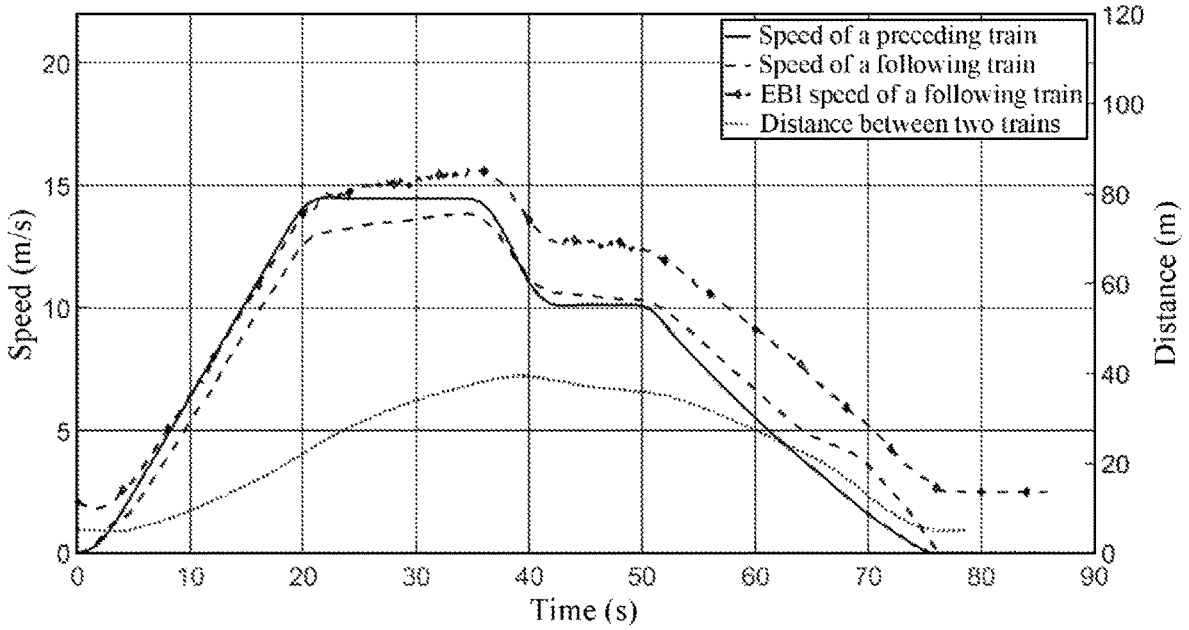

FIG. 6 is a graph showing speed and distance of preceding and following train units with time under the condition that each train unit still operates according to its own recommended speed curve and control errors of the following train unit are accumulated resulting in unsynchronization (the following train unit is relatively slower than the preceding train unit) according to an embodiment of the present disclosure;

FIG. 7 is a graph showing speed and distance of train units with time under the condition that VCTS is controlled by the present disclosure and the control errors of the following train unit are accumulated resulting in unsynchronization (the following train unit is relatively slower than the preceding train unit) according to an embodiment of the present disclosure;

FIG. 8 is a graph showing speed and distance of preceding and following train units with time under the condition that each train unit still operates according to its own recommended speed curve and the control errors of the following train unit are accumulated resulting in unsynchronization and overspeed (the following train unit is relatively faster than the preceding train unit) according to an embodiment of the present disclosure; and FIG. 9 is a graph showing speed and distance of train units with time under the condition that VCTS is controlled by the present disclosure and the control errors of the following train unit are accumulated resulting in unsynchronization (the following train unit is relatively faster than the preceding train unit) according to an embodiment of the present disclosure.

DETAILED DESCRIPTION

The technical solutions in the embodiments of the present disclosure will be clearly and completely described below with reference to the drawings in the embodiments of the present disclosure. Apparently, the described embodiments are only some embodiments of the present disclosure, rather than all of the embodiments. Based on the embodiment of the present disclosure, all other embodiments obtained by those skilled in the conventional art without creative efforts shall fall within the scope of protection of the present disclosure.

An objective of embodiments of the present disclosure is to provide a method and a system for VCTS control, so as to ensure that a synchronous operation relationship among all train units can be maintained, while the train units track their respective recommended driving curves.

To make the above objective, features and advantages of the present disclosure more apparent, the present disclosure will be further explained in detail below with references to the drawings and detailed description.

Embodiment 1

Figure 1:
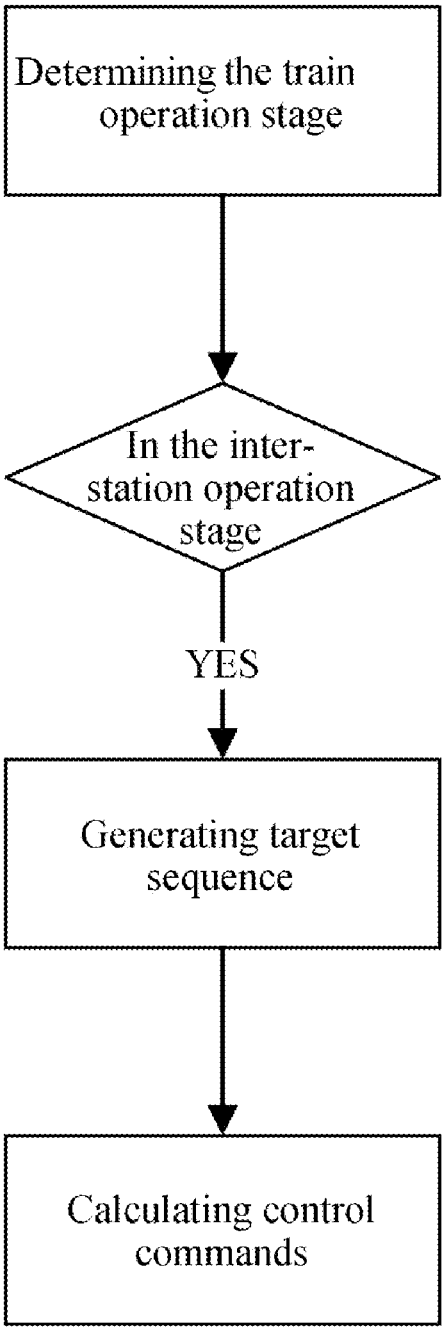
FIG. 1 is a flow chart of the method for VCTS control according to an embodiment of the present disclosure.

Embodiment 1 of the present disclosure provides a method for VCTS control. As shown in FIG. 1, the method includes steps of:

acquiring an actual state for a current cycle of each train unit in VCTS;

determining whether to execute a backup control strategy based on the actual state for the current cycle of each train unit and a target state sequence for a first preset number of cycles before the current cycle to obtain a first determination result; where the backup control strategy includes a control strategy for tracking a recommended driving curve by a first train unit and a control strategy for tracking the i-th train unit by the (i+1)-th train unit, where a value of i is greater than or equal to 1.

If the first determination result is yes, the backup control strategy is executed to control each train unit.

If the first determination result is no, following operations is executed:

determining whether synchronization of each train unit in VCTS meets a preset condition to obtain a second determination result;

if the second determination result is yes, calculating the target state sequence for the current cycle of each train unit based on a position according to the actual state for the current cycle of each train unit;

if the second determination result is no, calculating the target state sequence for the current cycle of each train unit by using a synchronization relationship according to the actual state for the current cycle of each train unit;

controlling each train unit according to the target state sequence for the current cycle of each train unit, respectively.

Figure 2:
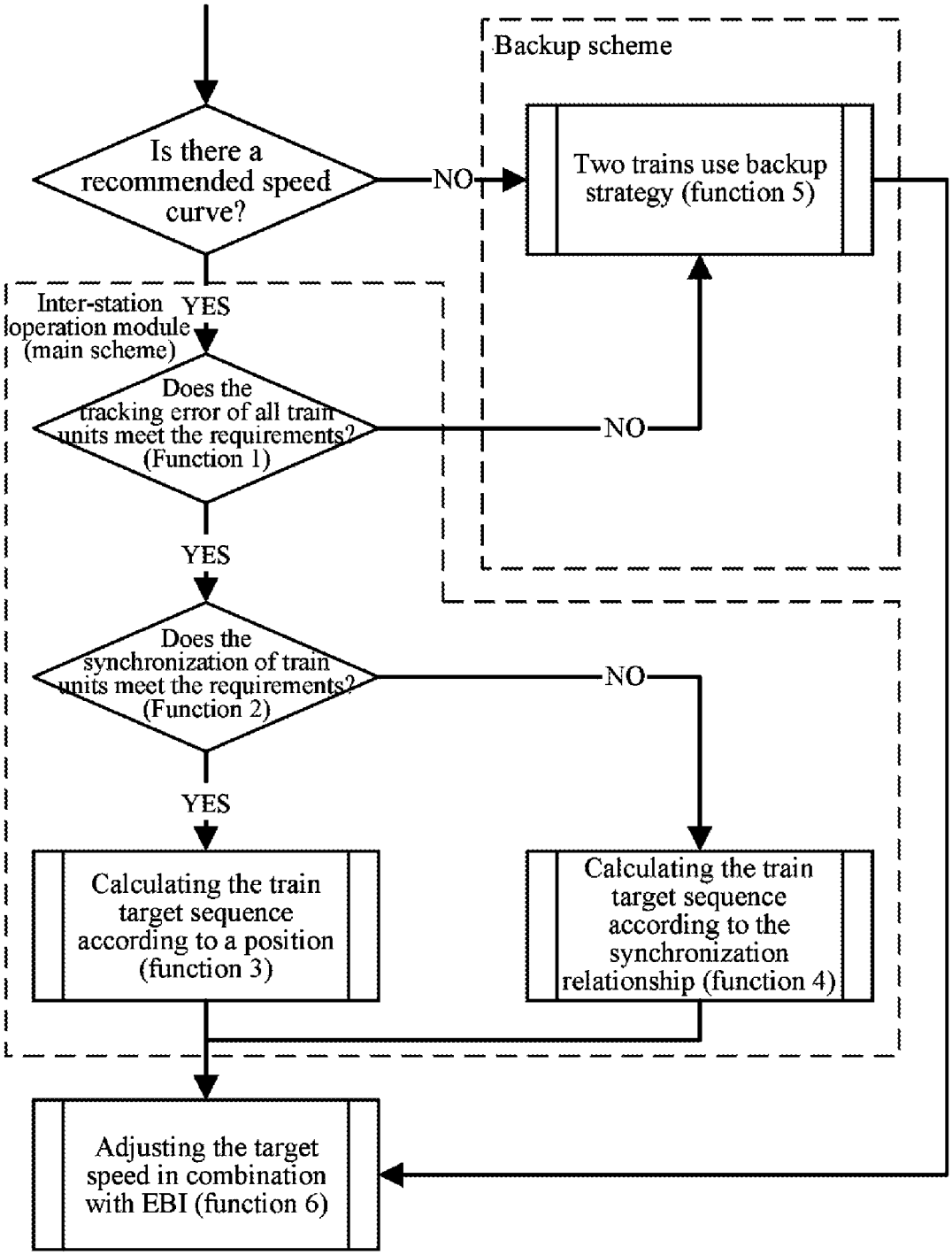
FIG. 2 is a process flow diagram of generating a target state sequence according to an embodiment of the present disclosure.

As shown in FIG. 2, the above method specifically includes following steps.

The position, speed and acceleration of the train unit i at time k are received and represented by $s_{i,k}$, $v_{i,k}$, and $a_{i,k}$, respectively, where i=1 or 2, representing a preceding train unit or a following train unit. First, the operation stage of VCTS is determined. When all the following conditions are true, VCTS is considered to be in the station arrival stage, otherwise, VCTS is considered to be in the inter-station operation stage: (1) the positions of all train units are within the station parking area; (2) the speeds of all train units are zero; (3) the countdown for parking is not zero; (4) no departure signal is received from the station.

In the case of the station arrival stage, other modules are responsible for handling the station operation function (the module can use the design in the existing research and inventions, and the present disclosure does not involve the design of the module for realizing this part of the function).

In the case of the inter-station operation stage, the control target sequence of each train unit is calculated.

The target sequence in the future is represented by $\bar{s}_{i,j|k}$, $\bar{v}_{i,j|k}$ and $\bar{a}_{i,j|k}$, where j=1, 2, . . . , N, N represents a prediction horizon. The recommended speed curve calculated offline is represented by $\hat{s}_{i,j|k}$, $\hat{v}_{i,j|k}$ and $\hat{a}_{i,j|k}$, and the sampling interval time is $\tau$.

The process proceeds to function 1 to determine whether the control errors of all train units are within an allowable range. When the control errors of all train units meet the requirement, which means that they can track the recommended driving curve well, the problems of asynchronous operation resulted from the accumulation of the control errors can be effectively alleviated by adjusting the target sequence. However, if the control effect of the train unit is not good enough to keep up with the target sequence, the difference between the actual state of the train and the target sequence is large, and thus it is difficult to determine the influence of adjusting the target sequence on the actual state, and it is difficult to achieve the goal of synchronous operation of train units by adjusting the target sequence. Therefore, first, it is determined whether the train can track the target (speed) well, so as to decide the ways of adjustment.

The function 1 is executed as follows.

(1) The difference $v_{i,k}-\bar{v}_{i,1|k-1}$ between the actual speed and the target speed is calculated.

(2) If the displayed control effect of the flag bit of a previous cycle is normal, it is determined whether the difference in n previous cycles meets the requirements of the threshold $V_{\bar{v}_r}$: $v_{i,j}-\bar{v}_{i,1|j-1}\in V_{\bar{v}_r}$, ∀j=k,k−1, . . . , k−n+1.

(3) If the displayed control effect of the flag bit of a previous cycle is abnormal, it is determined whether the difference within m previous cycles meets the requirements of the threshold $V_{\underline{v}_r}$, $v_{i,j}-\bar{v}_{i,1|j-1}\in V_{\underline{v}_r}$, ∀j=k, k−1, . . . , k−m+1.

(4) If the difference meets the requirement, the flag bit with the normal control effect is output, turning to the main control strategy.

(5) If the difference does not meet the requirement, the flag bit with the abnormal control effect is output, turning to the backup control strategy.

The design of the threshold is as follows. $V_{v_r}$ is used to represent a set:

$$V_{v_r} := \{\Delta v : \Delta v \le v_r\}$$

where $v_r$ can be a speed-related value $v_r=f(v_{1,k}, v_{2,k})$ or a constant value, which is determined according to the varying feature of the difference between the actual speed and the target speed in the experimental results. But it should be noted that $\bar{v}_r \ge \underline{v}_r$ and m≥n. This is to avoid the instability of the algorithm resulting from frequent switching between normal and abnormal determination results.

Then, proceed to function 2 to check the synchronization relationship of all train units. The synchronization of train units is determined by the time index for the current state of all train units on their respective recommended driving curves.

The function 2 is executed as follows.

(1) The time index of two train units is calculated: $t_{i,k}=T(s_{i,k})$, in which $T(s_{i,k})$ represents the function of converting the train position into the corresponding time index. A desired calculation method is:

$$T(s_{i,k}) = \min_j j + (s_{i,k} - \hat{s}_{i,j})/(\hat{s}_{i,j+1} - \hat{s}_{i,j}), \text{ s.t. } s_{i,k} \ge \hat{s}_{i,j}$$

(2) The time index difference between two train units is calculated: $\Delta t_k=t_{1,k}-t_{2,k}$.

(3) If the flag bit of a previous cycle shows that the time index difference between two train units is normal, it is determined whether the time index difference $\Delta t_k=t_{1,k}-t_{2,k}$ between both train units in n cycles meets the requirement $\Delta t_k \in T_{\bar{t}}$.

(4) If the flag bit of a previous cycle shows that the time index difference between two train units is abnormal, it is determined whether the time index difference $\Delta t_k=t_{1,k}-t_{2,k}$ between both train units in m cycles meets the requirement $\Delta t_k \in T_{\underline{t}}$.

(5) If the difference meets the requirement, the process turns to function 3.

(6) If the difference does not meet the requirement and the speeds of all train units are greater than $\bar{v}_a$, the process turns to function 4.

A desired design scheme of the threshold value $T_t$ is as follows:

$$T_t := \{\Delta t : \Delta t \le t\}$$

where t can be a speed-related value $t=f(v_{1,k}, v_{2,k})$ or a constant value, which is determined according to the variation characteristic of the difference between the target speed and the actual speed in the experimental results. But it should be noted that $\bar{t} \ge \underline{t}$ and m≥n. This is to avoid the instability of the algorithm resulting from frequent switching between normal and abnormal determination results.

According to the output value of the function 2, the process turns to function 3 to calculate the control target sequence in the future. If the process proceeds to function 3, it means that all train units have good tracking control performances and are still in synchronous operation at present. Therefore, all train units can calculate the target sequence according to their respective recommended driving curves, and still ensure the synchronous operation of the virtual coupling at small intervals.

The function 3 is executed as follows.

(1) The target speed for the current position where the train is located is calculated: $\bar{v}_{i,0|k}=V(\check{S}_{i,0|k})$, $\bar{s}_{i,0|k}=s_{i,k}$.

(2) According to a position and a speed at time j, the target position and speed at the next time j+1 in the future are calculated respectively as follows: $\bar{s}_{i,j+1|k}=\bar{s}_{i,j|k}+\tau\bar{V}_{i,j|k}$ and $\bar{v}_{i,j+1|k}=V(\bar{s}_{i,j+1|k})$, j=0, 1, . . . , N−1.

(3) Differential calculation is performed on the target speed to calculate the target acceleration $\bar{a}_{i,j|k}$, j=0, 1, . . . , N−1.

The calculation function $V_r(s_i)$ of the target speed is defined as $$V_r(s_i) = \hat{v}_{i,j} + \frac{(s_i - \hat{s}_{i,j})(\hat{v}_{i,j+1} - \hat{v}_{i,j})}{\hat{s}_{i,j+1} - \hat{s}_{i,j}}, \text{ s.t. } \hat{s}_{i,j} \le s_i < \hat{s}_{i,j+1}.$$

According to the output value of the function 2, the process turns to function 4 to calculate the control target sequence in the future. If the process turns to function 4, it means that the VCTS is not good in synchronization at this time, and need to be adjusted in combination with the real-time state. The basic idea of the design function 4 is to find the relative displacement by which the following train unit needs to be adjusted, through the time index of the preceding train unit, that is, to convert the time unsynchronization into the position unsynchronization. Thereafter, it is stipulated that the following train unit needs to adjust back by this displacement within a period of time.

The function 4 is executed as follows.

(1) When the process proceeds to the function 4 for the first time, the flag bit $F_a$=1 and the counter $c_a$=1 are initialized and adjusted. The distance difference $\Delta s_a=\hat{s}_{2,t_{1,k}}-\hat{s}_{2,t_{2,k}}$ between the corresponding positions of the time nodes for two train units searched on the recommended speed curve of the following train unit is calculated, and the maximum adjustment speed $\Delta v_a=T_a a_a-\sqrt{a_a^2 T_a^2/4-a_a\Delta s_a}$ is calculated, where $T_a$ and $a_a$ represent the adjustment time designed in advance and the acceleration in the adjustment process, respectively;

(2) The target speed of the following train unit at the current position of the recommended speed curve of the following train unit is calculated: $\bar{v}_{2,0|k}=V(\bar{s}_{2,0|k})+v_a(0)$, $\bar{s}_{2,0|k}=s_{2,k}$, where $v_a(j)$ represents the adjustment amount related to the synchronization of train units, which is expressed by the following formula:

$$v_a(j) = \begin{cases} (c_a + j)a_a\tau, & (c_a + j) \le \Delta v_a/a_a/\tau \\ \Delta v_a, & \Delta v_a/a_a/\tau \le (c_a + j) \le T_a/\tau - \Delta v_a/a_a/\tau \\ (T_a/\tau - (c_a + j))a_a & (c_a+j) \ge T_a/\tau-\Delta v_a/a_a/\tau \\ 0 & \text{else} \end{cases}$$

where $c_a$ is the number of cycles between the current cycle and a cycle during which adjustment is performed based on the adjustment amount for a first time and is used to characterize how many cycles have passed since adjustment for the first time by this equation. For example, when adjustment is performed by this method for the first time at a moment k of 10, $c_a$=2 at the moment k of 11, and $c_a$=3 at the moment k of 12, and so on.

(3) According to a position and a speed at time j, the target position and speed at the next time j+1 in the future are calculated: $\bar{s}_{i,j+1|k}=\bar{s}_{i,j|k}+\tau\bar{v}_{i,j|k}$ and $\bar{v}_{i,j+1|k}=V(\bar{s}_{i,j+1|k})+v_a(j)$ j=0, 1, . . . , N−1.

(4) Differential calculation is performed on the target speed to calculate the target acceleration $\bar{a}_{i,j|k}$, j=0, 1, . . . , N−1.

This design can eliminate the difference between the time nodes of two train units in a limited time domain $T_a$. Moreover, the speed adjustment value is gradually increased first, and then is gradually reduced to zero. The changing trend of the target speed sequence is reflected in the subsequent experimental results.

The process turns to function 5 according to the output values of the function 1 and the function 2. The implementation of the function 5 can follow the existing control method of tracking operation of VCTS, which will not be described in detail in the example of the present disclosure.

Finally, the process turns to function 6 to prevent the target speed of the train from being too high, resulting in emergency braking during the tracking operation. Its core is realized by determining the relationship between the current speed and the EBI speed of the train.

The function 6 is executed as follows.

(1) The difference $v_{i,k}-\bar{v}_{i,ebi}$ between the actual speed and the EBI speed is calculated.

(2) It is determined whether the difference in n cycles meets the requirement of the threshold $V_{ebi}$, $\bar{v}_{i,ebi}-v_{i,k}\in V_{ebi}$, ∀j=k, k−1, . . . , k−n+1, where $V_{ebi}$:={Δv: Δv≤$v_e$}, and $v_e$ is the EBI speed margin value designed in advance.

(4) If the difference meets the requirement, the calculated sequence of the target position, the speed and the acceleration is normally output.

(5) If the difference does not meet the requirement, the calculated sequence of the target position, the speed and the acceleration is adjusted as follows: calculating $$\Delta v_e = \frac{1}{n}\sum_{j=k-n+1}^{k} v_{i,k} - \bar{v}_{i,ebi} + v_e,$$

the following operation is performed on all target speeds: $\bar{v}_{i,j|k}=\bar{v}_{i,j|k}-k_e\Delta v_e$, where $k_e$ is a compensation proportional coefficient, and $\bar{s}_{i,j+1|k}=\bar{s}_{i,j|k}+\tau\bar{v}_{i,j|k}$, ∀j=0, 1, . . . , N−1.

(6) Differential calculation is performed on the target speed to calculate the target acceleration $\bar{a}_{i,j|k}$, j=0, 1, . . . , N−1.

Thereafter, according to the calculated target sequence, a control command generation module calculates the control command and acts on the train. Because the target generated at this time is a sequence of target states in the future, a model predictive control method can be selected to calculate the control command.

Figure 3:
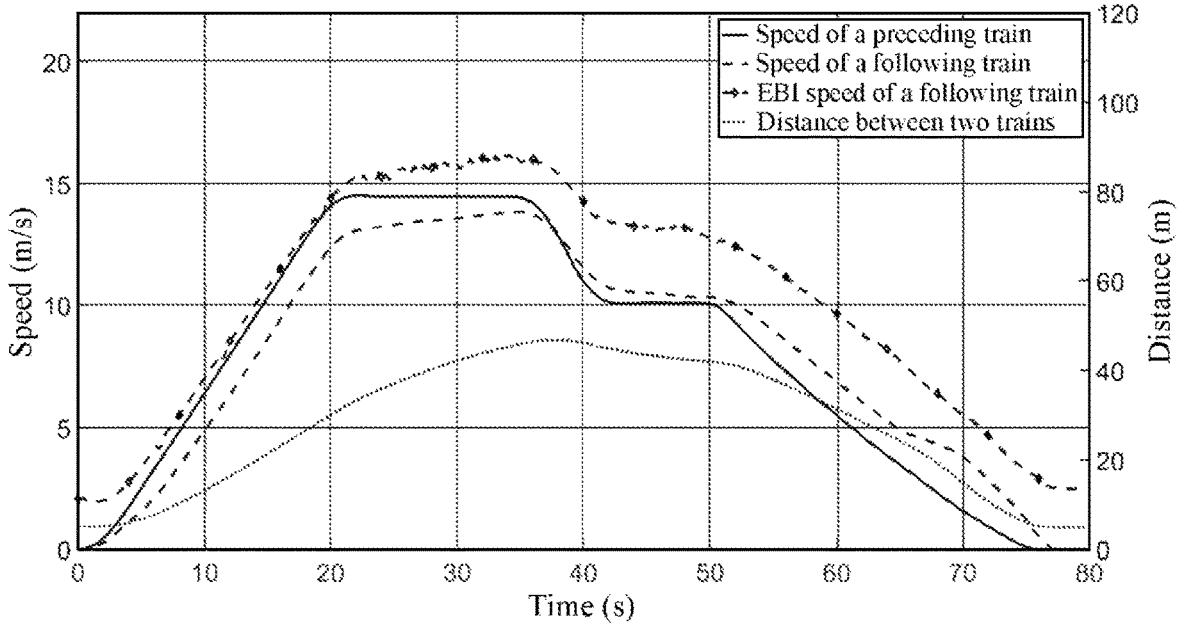
FIG. 3 is a graph showing speed and distance of preceding and following train units with time under an ideal control effect according to an embodiment of the present disclosure.

In FIG. 3, the speed-time graph and distance-time graph of preceding and following train units under the ideal control effect (when following a recommended driving curve) are given. The arrival time interval between both train units at the target station is 1.6 seconds. Further, the following three scenarios are experimented to show some benefits of the present disclosure.

Figure 4:
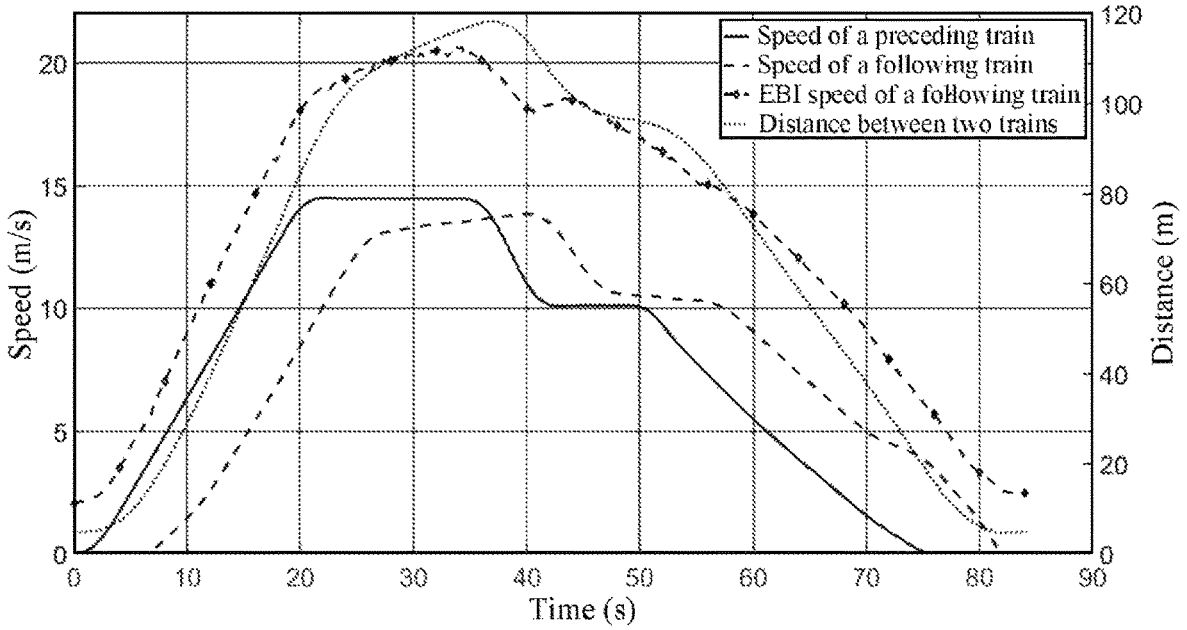
FIG. 4 is a graph showing speed and distance of preceding and following train units with time under the condition that each train unit still operates according to its own recommended speed curve and the departure of the following train unit is delayed, according to an embodiment of the present disclosure.

In a first scenario, the departure of the following train unit is delayed by 5 seconds. If the control method described in the present disclosure is not used, but each train unit still operates according to its own recommended speed curve, the speed-time relationship and the distance-time relationship between the preceding and following train units are shown in FIG. 4. The arrival time interval between the two train units at the target station is 7.2 seconds, which is 5.6 seconds more than that in a benchmark experiment.

Figure 5:
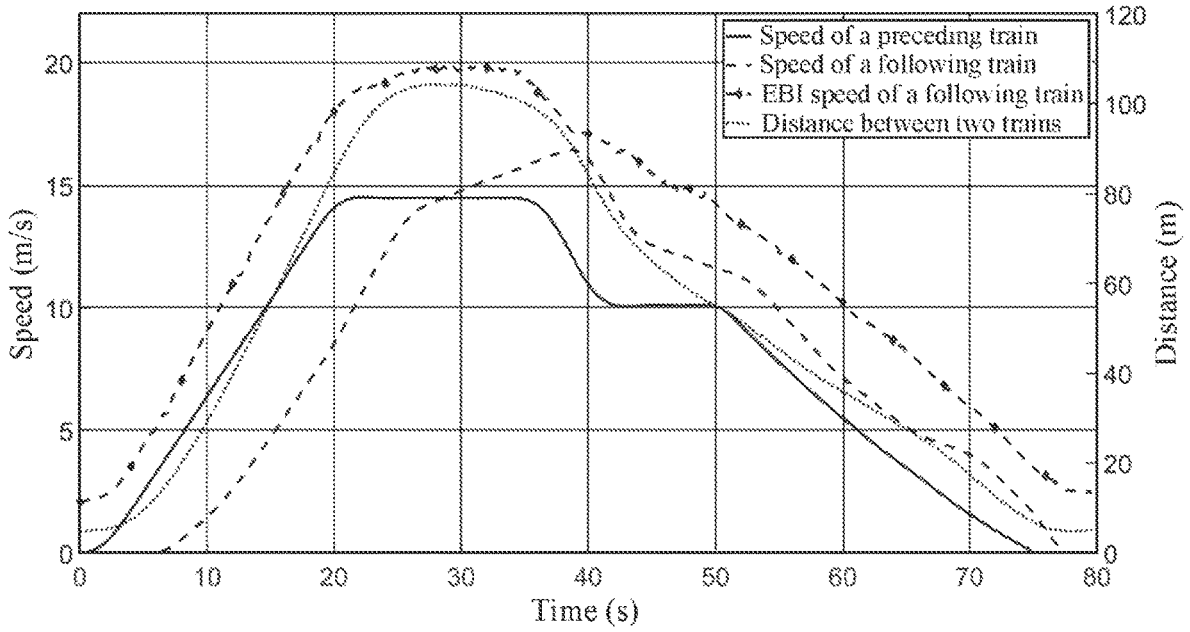
FIG. 5 is a graph showing speed and distance of train units with time under the condition that VCTS is controlled by the present disclosure and the departure of the following train unit is delayed, according to an embodiment of the present disclosure.

If the system and the method for VCTS control according to the present disclosure are used, the speed-time relationship and the distance-time relationship between the preceding and following train units are shown in FIG. 5. The arrival time interval between the two train units at the target station is 2.8 seconds. When the speed of the following train unit is higher than 8 m/s, the function 4 is enabled. The calculated control target is to add a speed adjustment amount on the basis of the recommended driving curve. The adjustment time reserved in advance is 40 seconds, which means that the speed of the following train unit after 40 seconds should be consistent with the result of the benchmark experiment. The results in FIG. 3 and FIG. 4 also prove this point.

In a second scenario, the accumulated value of the control errors of the following train unit causes the two train units to be out of synchronization. If the control method described in the present disclosure is not used, but each train unit still operates according to its own recommended speed curve, the speed-time relationship and the distance-time relationship between the preceding and following train units are shown in FIG. 6. The arrival time interval between the two train units at the target station is 4.2 seconds. It can be seen that in an initial traction stage, the following train unit operates slower than the preceding train unit due to the accumulation of control errors. Because both train units are tracking their recommended speed curves, this error has been accumulated to the final arrival stage, resulting in an increase of the arrival time interval.

If the system and the method for VCTS control according to the present disclosure are used, the speed-time relationship and the distance-time relationship between the preceding and following train units are shown in FIG. 7. The arrival time interval between both train units at the target station is 1.2 seconds.

In a third scenario, the control error of the following train unit causes the following train unit to operate faster than the preceding train unit, and the difference between the speed of the following train unit and the EBI speed is smaller than that in the benchmark experiment. If the control method described in the present disclosure is not used, but each train unit still operates according to its own recommended speed curve, the speed-time relationship and the distance-time relationship between the preceding and following train units are shown in FIG. 8. The speed of the following train unit is higher than the EBI speed at the 17th second, so that the emergency braking is carried out.

If the system and the method for VCTS control according to the present disclosure are used, the speed-time relationship and the distance-time relationship between the preceding and following train units are shown in FIG. 9. It can be seen that the difference between the speed of the following train unit and the EBI speed at this time is smaller than the result of the benchmark experiment in FIG. 3, but larger than the result in FIG. 8, and there is no following train unit carrying out emergency braking due to overspeed.

By comparing the result in FIG. 4 with the result in FIG. 5, the result in FIG. 6 with the result in FIG. 7, and the result in FIG. 8 with the result in FIG. 9, it can be proved that some embodiments of the present disclosure have the following benefits.

(1) The present disclosure can effectively reduce the effects from the delay of the departure of the following train unit in VCTS, reduce the following distance of the train units in VCTS, and improve the synchronization of arriving at the station.

(2) The VCTS controlled by the present disclosure can meet the safety protection constraints, avoid triggering emergency braking, and ensure the stability of operation of the virtual coupling.

Embodiment 2

Embodiment 2 of the present disclosure provides a system for VCTS control, where the system is applied to the method described above, and the system includes a state acquiring module, a first determination module, a first control module, a second determination module, a first target state sequence calculating module, a second state sequence calculating module, and a second control module.

The state acquiring module is configured to acquire an actual state for a current cycle of each train unit in VCTS.

The first determination module is configured to determine whether to execute a backup control strategy based on the actual state for the current cycle of each train unit and a target state sequence for a first preset number of cycles before the current cycle to obtain a first determination result; where the backup control strategy includes a control strategy for tracking a recommended driving curve by a first train unit and a control strategy for tracking the i-th train unit by the (i+1)-th train unit, where the value of i is greater than or equal to 1.

The first control module is configured to execute the backup control strategy to control each train unit, if the first determination result is yes.

The second determination module is configured to obtain a second determination result, by determining whether synchronization of each train unit in VCTS meets a preset condition, if the first determination result is no.

The first target state sequence calculating module is configured to calculate the target state sequence for the current cycle of each train unit based on a position according to the actual state for the current cycle of each train unit, if the second determination result is yes.

The second state sequence calculating module is configured to calculate the target state sequence for the current cycle of each train unit by using a synchronization relationship according to the actual state for the current cycle of each train unit, if the second determination result is no.

The second control module is configured to control each train unit according to the target state sequence for the current cycle of each train unit, respectively.

The present disclosure provides an electronic device including a memory, a processor and a computer program stored in the memory and executable on the processor, where the processor implements the method described above when executing the computer program.

The present disclosure provides a computer-readable storage medium storing a computer program that is executed to implement the method described above.

The technical solution of the present disclosure based on the above embodiments has the following beneficial effect.

According to the present disclosure, the recommended driving curve is taken as the control target under normal conditions, and the real-time control target can be adaptively and dynamically adjusted actively on the basis of the recommended driving curve under disturbance conditions. Thereafter, the control command is calculated and output to the train according to the control target. Therefore, the present disclosure can control the VCTS to arrive in the station synchronously under disturbances and prevent the following train unit from triggering emergency braking due to overspeed.

Embodiments of the present invention are described in a progressive manner, each embodiment focuses on the difference from other embodiments, and the same and similar parts between the embodiments may refer to each other. Since the system disclosed in an embodiment corresponds to the method disclosed in another embodiment, the description is relatively simple, and reference can be made to the method description.

Although the invention has been illustrated and described in greater detail with reference to the exemplary embodiments, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

The invention claimed is:

1. A method for virtually coupled train set (VCTS) control, comprising:

acquiring an actual state for a current cycle of each train unit in VCTS;

determining whether to execute a backup control strategy based on the actual state for the current cycle of each train unit and a target state sequence for a first predetermined number of cycles before the current cycle, to obtain a first determination result; wherein the backup control strategy comprises a control strategy for tracking a recommended driving curve by a first train unit and a control strategy for tracking a i-th train unit by a (i+1)-th train unit, wherein a value of i is greater than or equal to 1;

executing the backup control strategy to control each train unit, if the first determination result is yes;

executing following operations, if the first determination result is no:

determining whether synchronization of each train unit in the VCTS meets a predetermined condition, to obtain a second determination result;

calculating a target state sequence for the current cycle of each train unit based on a position according to the actual state for the current cycle of each train unit, if the second determination result is yes;

calculating the target state sequence for the current cycle of each train unit by using a synchronization relationship according to the actual state for the current cycle of each train unit, if the second determination result is no;

controlling each train unit according to the target state sequence for the current cycle of each train unit, respectively.

2. The method according to claim 1, wherein the determining whether to execute a backup control strategy based on the actual state for the current cycle of each train unit and a target state sequence for a first predetermined number of cycles before the current cycle to obtain a first determination result comprises:

determining whether a flag bit of a first cycle before the current cycle is displayed normally, to obtain a third determination result;

determining whether a difference between an actual speed for the current cycle of each train unit and a first target speed in a target state sequence for n cycles before the current cycle is less than a speed difference threshold, if the third determination result is yes; wherein if the difference between the speed of for the current cycle of each train unit and the first target speed in the target state sequence in for the n cycles before a the current cycle is less than the speed difference threshold, the first determination result is yes, and a flag bit of the current cycle is set as normal, otherwise, the first determination result is no, and the flag bit of the current cycle is set as abnormal;

determining whether a difference between the actual speed for the current cycle of each train unit and a first target speed in a target state sequence for m cycles before the current cycle is less than the speed difference threshold, if the third determination result is no; wherein if the difference between the speed for of the current cycle of each train unit and the first target speed in the target state sequence in for the m cycles before a the current cycle is less than the speed difference threshold, the first determination result is yes, and the flag bit of the current cycle is set as normal, otherwise, the first determination result is no, and the flag bit of the current cycle is set as abnormal, wherein n and m are values of the first predetermined number in different situations, and m≥n.

3. The method according to claim 1, wherein the determining whether synchronization of each train unit in the VCTS meets a predetermined condition to obtain a second determination result comprises:

confirming that the second determination result is yes when time index deviations between any two adjacent train units in the VCTS are all less than a time index deviation threshold;

confirming that the second determination result is no when the time index deviations between any two adjacent train units in the VCTS are not all less than the time index deviation threshold.

4. The method according to claim 1, wherein the calculating a target state sequence for the current cycle of each train unit based on a position according to the actual state for the current cycle of each train unit comprises:

determining, according to an actual position and an actual speed for the current cycle of each train unit, an initial target state as:

$$\bar{s}_{i,0|k} = s_{i,k},\ \bar{v}_{i,0|k} = V(\bar{s}_{i,0|k}),\ i = 1, 2, 3, \ldots, I;$$

wherein $\bar{s}_{i,0|k}$ is an initial target position in a target state sequence for the current cycle of the i-th train unit, $\bar{v}_{i,0|k}$ is an initial target speed in the target state sequence for the current cycle of the i-th train unit, $s_{i,k}$ and $v_{i,k}$ are an actual position and an actual speed for the current cycle of the i-th train unit, respectively, V( ) is a calculation function of a target speed, $$V(\bar{s}_{i,0|k}) = \hat{v}_{i,q} + \frac{(\bar{s}_{i,0|k} - \hat{s}_{i,q})(\hat{v}_{i,q+1} - \hat{v}_{i,q})}{\hat{s}_{i,q+1} - \hat{s}_{i,q}},\ \text{s.t. } \hat{s}_{i,q} \le \bar{s}_{i,0|k} < \hat{s}_{i,q+1},$$

$\hat{s}_{i,q}$ and $\hat{s}_{i,q+1}$ represent q-th and (q+1)-th recommended position values on a recommended driving curve of the i-th train unit, respectively, $\hat{v}_{i,q}$ and $\hat{v}_{i,q+1}$ represent q-th and (q+1)-th recommended speed values on the recommended driving curve of the i-th train unit, respectively, and I is a number of train units in the VCTS;

calculating, based on the initial target position and the initial target speed, a target position and a target speed in the target state sequence for the current cycle of each train unit based on following formulas:

$$\bar{s}_{i,j+1|k} = \bar{s}_{i,j|k} + \tau\bar{v}_{i,j|k},\ j = 0, 1, \ldots, N-1$$

$$\bar{v}_{i,j+1|k} = V(\bar{s}_{i,j+1|k})$$

wherein $\bar{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, N is a number of target states in the target state sequence, $\tau$ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{i,p})}{\hat{s}_{i,p+1} - \hat{s}_{i,p}}, \text{ s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively;

performing differential calculation on the target speed in the target state sequence for the current cycle of each train unit to obtain a target acceleration in the target state sequence for the current cycle of each train unit.

5. The method according to claim 1, wherein the calculating the target state sequence for the current cycle of each train unit by using a synchronization relationship according to the actual state for the current cycle of each train unit comprises:

determining, according to an actual position and an actual speed for the current cycle of each train unit, an initial target state of each train unit as:

$$\bar{s}_{i,0|k} = s_{i,k},\ \bar{v}_{1,0|k} = V(\bar{s}_{1,0|k}),\ \bar{v}_{i',0|k} = V(\bar{s}_{i',0|k}) + v_a(0),\ i' = 2, 3, \ldots, I;$$

wherein $\bar{s}_{i,0|k}$ is an initial target position in a target state sequence for the current cycle of the i-th train unit, $s_{i,k}$ is an actual position for the current cycle of the i-th train unit, $\bar{v}_{1,0|k}$ and $\bar{v}_{i',0|k}$ are initial target speeds in target state sequences for the current cycle of the first train unit and a i'-th train unit, respectively, $v_a(0)$ is an adjustment amount of the initial target speed in the target state sequence for the current cycle of the i-th train unit, V( ) is a calculation function of a target speed, $$V(\bar{s}_{i,0|k}) = \hat{v}_{i,q} + \frac{(\bar{s}_{i,0|k} - \hat{s}_{i,q})(\hat{v}_{i,q+1} - \hat{v}_{i,q})}{\hat{s}_{i,q+1} - \hat{s}_{i,q}}, \text{ s.t. } \hat{s}_{i,q} \le \bar{s}_{i,0|k} < \hat{s}_{i,q+1},$$

$\hat{s}_{i,q}$ and $\hat{s}_{i,q+1}$ represent q-th and (q+1)-th recommended position values on the recommended driving curve of the i-th train unit, respectively, $\hat{v}_{i,q}$ and $\hat{v}_{i,q+1}$ represent q-th and (q+1)-th recommended speed values on the recommended driving curve of the i-th train unit, respectively, and I is a number of train units;

calculating, based on the initial target state, a target position and a target speed in the target state sequence for the current cycle of each train unit based on following formulas:

$$\bar{s}_{i,j+1|k} = \bar{s}_{i,j|k} + \tau\bar{v}_{i,j|k},\ j = 0, 1, \ldots, N-1$$

$$\bar{v}_{i,j+1|k} = V(\bar{s}_{i,j+1|k}) + v_a(j))$$

wherein $\bar{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, $\tau$ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{i,p})}{\hat{s}_{i,p+1} - \hat{s}_{i,p}}, \text{ s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively, and $v_a(j)$ is an adjustment amount of the j-th target speed in the target state sequence;

performing differential calculation on the target speed in the target state sequence for the current cycle of each train unit to obtain a target acceleration in the target state sequence for the current cycle of each train unit.

6. The method according to claim 5, wherein a calculation formula of the adjustment amount of the j-th target speed in the target state sequence is:

$$v_a(j) = \begin{cases} (c_a + j)a_a\tau, & (c_a + j) \le \Delta v_a/a_a/\tau \\ \Delta v_a, & \Delta v_a/a_a/\tau \le (c_a + j) \le T_a/\tau - \Delta v_a/a_a/\tau \\ (T_a/\tau - (c_a + j))a_a & (c_a + j) \ge T_a/\tau - \Delta v_a/a_a/\tau \\ 0 & \text{else} \end{cases}$$

wherein $c_a$ is a number of cycles between the current cycle and a cycle during which adjustment is performed based on the adjustment amount for a first time, $a_a$ is a predetermined adjustment acceleration, $\tau$ is the sampling interval time, $\Delta v_a$ is a maximum adjustment speed, and $T_a$ is a predetermined adjustment time.

7. The method according to claim 1, wherein prior to the controlling each train unit according to the target state sequence for the current cycle of each train unit, the method further comprises:

executing following operations, when a difference between an actual speed and an emergency braking intervention (EBI) speed for a second predetermined number of cycles between a previous moment and the current cycle of each train unit does not meet a predetermined condition:

adjusting a target speed and a target position in the target state sequence for the current cycle of each train unit based on following formulas:

$$\bar{v}'_{i,j|k} = \bar{v}_{i,j|k} - k_e\Delta v_e$$

$$\bar{s}'_{i,j+1|k} = \bar{s}'_{i,j|k} + \tau\bar{v}'_{i,j|k}$$

$$\Delta v_e = \frac{1}{l}\sum_{l=k-n+1}^{k} v_{i,l} - \bar{v}_{i,ebi} + v_e$$

wherein $\bar{v}'_{i,j|k}$ is a j-th adjusted target speed in the target state sequence for the current cycle of the i-th train unit, $\bar{s}'_{i,j|k}$ and $\bar{s}'_{i,j+1|k}$ are j-th and (j+1)-th adjusted target positions in the target state sequence for the current cycle of the i-th train unit, respectively, $\bar{v}_{i,j|k}$ is a j-th target speed in the target state sequence for the current cycle of the i-th train unit, $k_e$ is a compensation proportional coefficient, $\tau$ is a sampling interval time, $\Delta v_e$ is a speed compensation amount, $v_{i,l}$ is an actual speed at a l-th moment before the current cycle, l−1 is a second predetermined number, $\bar{v}_{i,ebi}$ is an EBI speed of the i-th train unit, and $v_e$ is an EBI speed margin value;

performing differential calculation on an adjusted target speed in the target state sequence for the current cycle of each train unit to obtain an adjusted target acceleration in the target state sequence for the current cycle of each train unit.

8. A system for virtually coupled train set (VCTS) control wherein the system is applied to the method according to claim 1, and the system comprises:

a state acquiring module, configured to acquire an actual state for a current cycle of each train unit in VCTS;

a first determination module, configured to determine whether to execute a backup control strategy based on the actual state for the current cycle of each train unit and a target state sequence for a first predetermined number of cycles before the current cycle to obtain a first determination result; wherein the backup control strategy comprises a control strategy for tracking a recommended driving curve by a first train unit and a control strategy for tracking a i-th train unit by a (i+1)-th train unit, wherein a value of i is greater than or equal to 1;

a first control module, configured to execute the backup control strategy to control each train unit, if the first determination result is yes;

a second determination module, configured to determine whether synchronization of each train unit in the VCTS meets a predetermined condition to obtain a second determination result, if the first determination result is no;

a first target state sequence calculating module, configured to calculate the target state sequence for the current cycle of each train unit based on a position according to the actual state for the current cycle of each train unit, if the second determination result is yes;

a second state sequence calculating module, configured to calculate the target state sequence for the current cycle of each train unit by using a synchronization relationship according to the actual state for the current cycle of each train unit, if the second determination result is no;

a second control module, configured to control each train unit according to the target state sequence for the current cycle of each train unit, respectively.

9. The system according to claim 8, wherein the determining whether to execute a backup control strategy based on the actual state for the current cycle of each train unit and a target state sequence for a first predetermined number of cycles before the current cycle to obtain a first determination result comprises:

determining whether a flag bit of a first cycle before the current cycle is displayed normally, to obtain a third determination result;

determining whether a difference between an actual speed for the current cycle of each train unit and a first target speed in a target state sequence for n cycles before the current cycle is less than a speed difference threshold, if the third determination result is yes; wherein if the difference between the speed of for the current cycle of each train unit and the first target speed in the target state sequence in for the n cycles before a the current cycle is less than the speed difference threshold, the first determination result is yes, and a flag bit of the current cycle is set as normal, otherwise, the first determination result is no, and the flag bit of the current cycle is set as abnormal;

determining whether a difference between the actual speed for the current cycle of each train unit and a first target speed in a target state sequence for m cycles before the current cycle is less than the speed difference threshold, if the third determination result is no; wherein if the difference between the speed for of the current cycle of each train unit and the first target speed in the target state sequence in for the m cycles before a the current cycle is less than the speed difference threshold, the first determination result is yes, and the flag bit of the current cycle is set as normal, otherwise, the first determination result is no, and the flag bit of the current cycle is set as abnormal, wherein n and m are values of the first predetermined number in different situations, and m≥n.

10. The system according to claim 8, wherein the determining whether synchronization of each train unit in the VCTS meets a predetermined condition to obtain a second determination result comprises:

confirming that the second determination result is yes when time index deviations between any two adjacent train units in the VCTS are all less than a time index deviation threshold;

confirming that the second determination result is no when the time index deviations between any two adjacent train units in the VCTS are not all less than the time index deviation threshold.

11. The system according to claim 8, wherein the calculating a target state sequence for the current cycle of each train unit based on a position according to the actual state for the current cycle of each train unit comprises:

determining, according to an actual position and an actual speed for the current cycle of each train unit, an initial target state as:

$$\bar{s}_{i,0|k} = s_{i,k},\ \bar{v}_{i,0|k} = V(\bar{s}_{i,0|k}),\ i = 1, 2, 3, \ldots, I;$$

wherein $\bar{s}_{i,0|k}$ is an initial target position in a target state sequence for the current cycle of the i-th train unit, $\bar{v}_{i,0|k}$ is an initial target speed in the target state sequence for the current cycle of the i-th train unit, $s_{i,k}$ and $v_{i,k}$ are an actual position and an actual speed for the current cycle of the i-th train unit, respectively, V( ) is a calculation function of a target speed, $$V(\bar{s}_{i,0|k}) = \hat{v}_{i,q} + \frac{(\bar{s}_{i,0|k} - \hat{s}_{i,q})(\hat{v}_{i,q+1} - \hat{v}_{i,q})}{\hat{s}_{i,q+1} - \hat{s}_{i,q}},\ \text{s.t. } \hat{s}_{i,q} \le \bar{s}_{i,0|k} < \hat{s}_{i,q+1},$$

$\hat{s}_{i,q}$ and $\hat{s}_{i,q+1}$ represent q-th and (q+1)-th recommended position values on a recommended driving curve of the i-th train unit, respectively, $\bar{v}_{i,q}$ and $\hat{v}_{i,q+1}$ represent q-th and (q+1)-th recommended speed values on the recommended driving curve of the i-th train unit, respectively, and I is a number of train units in the VCTS;

calculating, based on the initial target position and the initial target speed, a target position and a target speed in the target state sequence for the current cycle of each train unit based on following formulas:

$$\bar{s}_{i,j+1|k} = \bar{s}_{i,j|k} + \tau\bar{v}_{i,j|k},\ j = 0, 1, \ldots, N-1$$

$$\bar{v}_{i,j+1|k} = V(\bar{s}_{i,j+1|k})$$

wherein $\bar{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, N is a number of target states in the target state sequence, $\tau$ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{i,p})}{\hat{s}_{i,p+1} - \hat{s}_{i,p}},\ \text{s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively;

performing differential calculation on the target speed in the target state sequence for the current cycle of each train unit to obtain a target acceleration in the target state sequence for the current cycle of each train unit.

12. The system according to claim 8, wherein the calculating the target state sequence for the current cycle of each train unit by using a synchronization relationship according to the actual state for the current cycle of each train unit comprises:

determining, according to an actual position and an actual speed for the current cycle of each train unit, an initial target state of each train unit as:

$$\bar{s}_{i,0|k} = s_{i,k},\ \bar{v}_{1,0|k} = V(\bar{s}_{1,0|k}),\ \bar{v}_{i',0|k} = V(\bar{s}_{i',0|k}) + v_a(0),\ i' = 2, 3, \ldots, I;$$

wherein $\bar{s}_{i,0|k}$ is an initial target position in a target state sequence for the current cycle of the i-th train unit, $s_{i,k}$ is an actual position for the current cycle of the i-th train unit, $\bar{v}_{1,0|k}$ and $\bar{v}_{i',0|k}$ are initial target speeds in target state sequences for the current cycle of the first train unit and a i'-th train unit, respectively, $v_a(0)$ is an adjustment amount of the initial target speed in the target state sequence for the current cycle of the i-th train unit, V( ) is a calculation function of a target speed, $$V(\bar{s}_{i,0|k}) = \hat{v}_{i,q} + \frac{(\bar{s}_{i,0|k} - \hat{s}_{i,q})(\hat{v}_{i,q+1} - \hat{v}_{i,q})}{\hat{s}_{i,q+1} - \hat{s}_{i,q}},\ \text{s.t. } \hat{s}_{i,q} \le \bar{s}_{i,0|k} < \hat{s}_{i,q+1},$$

$\hat{s}_{i,q}$ and $\hat{s}_{i,q+1}$ represent q-th and (q+1)-th recommended position values on the recommended driving curve of the i-th train unit, respectively, $\hat{v}_{i,q}$ and $\hat{v}_{i,q+1}$ represent q-th and (q+1)-th recommended speed values on the recommended driving curve of the i-th train unit, respectively, and I is a number of train units;

calculating, based on the initial target state, a target position and a target speed in the target state sequence for the current cycle of each train unit based on following formulas:

$$\bar{s}_{i,j+1|k} = \bar{s}_{i,j|k} + \tau\bar{v}_{i,j|k},\ j = 0, 1, \ldots, N-1$$

$$\bar{v}_{i,j+1|k} = V(\bar{s}_{i,j+1|k}) + v_a(j)$$

wherein $\hat{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, $\tau$ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{i,p})}{\hat{s}_{i,p+1} - \hat{s}_{i,p}},\ \text{s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively, and $v_a(j)$ is an adjustment amount of the j-th target speed in the target state sequence;

performing differential calculation on the target speed in the target state sequence for the current cycle of each train unit to obtain a target acceleration in the target state sequence for the current cycle of each train unit.

13. The system according to claim 12, wherein a calculation formula of the adjustment amount of the j-th target speed in the target state sequence is:

$$v_a(j) = \begin{cases} (c_a + j)a_a\tau, & (c_a + j) \le \Delta v_a/a_a/\tau \\ \Delta v_a, & \Delta v_a/a_a/\tau \le (c_a + j) \le T_a/\tau - \Delta v_a/a_a/\tau \\ (T_a/\tau - (c_a + j))a_a & (c_a + j) \ge T_a/\tau - \Delta v_a/a_a/\tau \\ 0 & \text{else} \end{cases}$$

wherein $c_a$ is a number of cycles between the current cycle and a cycle during which adjustment is performed based on the adjustment amount for a first time, $a_a$ is a predetermined adjustment acceleration, $\tau$ is the sampling interval time, $\Delta v_a$ is a maximum adjustment speed, and $T_a$ is a predetermined adjustment time.

14. The system according to claim 8, wherein prior to the controlling each train unit according to the target state sequence for the current cycle of each train unit, the method further comprises:

executing following operations, when a difference between an actual speed and an emergency braking intervention (EBI) speed for a second predetermined number of cycles between a previous moment and the current cycle of each train unit does not meet a predetermined condition:

adjusting a target speed and a target position in the target state sequence for the current cycle of each train unit based on following formulas:

$$\bar{v}'_{i,j|k} = \bar{v}_{i,j|k} - k_e \Delta v_e$$

$$\bar{s}'_{i,j+1|k} = \bar{s}'_{i,j|k} + \tau \bar{v}'_{i,j|k}$$

$$\Delta v_e = \frac{1}{l} \sum_{l=k-n+1}^{k} v_{i,l} - \bar{v}_{i,ebi} + v_e$$

wherein $\bar{v}'_{i,j|k}$ is a j-th adjusted target speed in the target state sequence for the current cycle of the i-th train unit, $\bar{s}'_{i,j|k}$ and $\bar{s}'_{i,j+1|k}$ are j-th and (j+1)-th adjusted target positions in the target state sequence for the current cycle of the i-th train unit, respectively, $\bar{v}_{i,j|k}$ is a j-th target speed in the target state sequence for the current cycle of the i-th train unit, $k_e$ is a compensation proportional coefficient, $\tau$ is a sampling interval time, $\Delta v_e$ is a speed compensation amount, $v_{i,l}$ is an actual speed at a l-th moment before the current cycle, l−1 is a second predetermined number, $\bar{v}_{i,ebi}$ is an EBI speed of the i-th train unit, and $v_e$ is an EBI speed margin value;

performing differential calculation on an adjusted target speed in the target state sequence for the current cycle of each train unit to obtain an adjusted target acceleration in the target state sequence for the current cycle of each train unit.

15. An electronic device comprising a memory, a processor and a computer program product, comprising a computer readable hardware storage device having computer readable program code stored therein, said program code executable by a processor of a computer system to implement a method stored in the memory and executable on the processor, wherein the processor implements the method according to claim 1 when executing the computer program.

16. The electronic device according to claim 15, wherein the determining whether to execute a backup control strategy based on the actual state for the current cycle of each train unit and a target state sequence for a first predetermined number of cycles before the current cycle to obtain a first determination result comprises:

determining whether a flag bit of a first cycle before the current cycle is displayed normally, to obtain a third determination result;

determining whether a difference between an actual speed for the current cycle of each train unit and a first target speed in a target state sequence for n cycles before the current cycle is less than a speed difference threshold, if the third determination result is yes; wherein if the difference between the speed of for the current cycle of each train unit and the first target speed in the target state sequence in for the n cycles before a the current cycle is less than the speed difference threshold, the first determination result is yes, and a flag bit of the current cycle is set as normal, otherwise, the first determination result is no, and the flag bit of the current cycle is set as abnormal;

determining whether a difference between the actual speed for the current cycle of each train unit and a first target speed in a target state sequence for m cycles before the current cycle is less than the speed difference threshold, if the third determination result is no; wherein if the difference between the speed for of the current cycle of each train unit and the first target speed in the target state sequence in for the m cycles before a the current cycle is less than the speed difference threshold, the first determination result is yes, and the flag bit of the current cycle is set as normal, otherwise, the first determination result is no, and the flag bit of the current cycle is set as abnormal, wherein n and m are values of the first predetermined number in different situations, and m≥n.

17. The electronic device according to claim 15, wherein the determining whether synchronization of each train unit in the VCTS meets a predetermined condition to obtain a second determination result comprises:

confirming that the second determination result is yes when time index deviations between any two adjacent train units in the VCTS are all less than a time index deviation threshold;

confirming that the second determination result is no when the time index deviations between any two adjacent train units in the VCTS are not all less than the time index deviation threshold.

18. The electronic device according to claim 15, wherein the calculating a target state sequence for the current cycle of each train unit based on a position according to the actual state for the current cycle of each train unit comprises:

determining, according to an actual position and an actual speed for the current cycle of each train unit, an initial target state as:

$$\bar{s}_{i,0|k} = s_{i,k},\ \bar{v}_{i,0|k} = V(\bar{s}_{i,0|k}),\ i = 1, 2, 3, \ldots, I;$$

wherein $\bar{s}_{i,0|k}$ is an initial target position in a target state sequence for the current cycle of the i-th train unit, $\bar{v}_{i,0|k}$ is an initial target speed in the target state sequence for the current cycle of the i-th train unit, $s_{i,k}$ and $v_{i,k}$ are an actual position and an actual speed for the current cycle of the i-th train unit, respectively, V( ) is a calculation function of a target speed, $$V(\bar{s}_{i,0|k}) = \hat{v}_{i,q} + \frac{(\bar{s}_{(i,0|k)} - \hat{s}_{i,q})(\hat{v}_{i,q+1} - \hat{v}_{i,q})}{\hat{s}_{i,q+1} - \hat{s}_{i,q}},\ \text{s.t. } \hat{s}_{i,q} \le \bar{s}_{i,0|k} < \hat{s}_{i,q+1},$$

$\hat{s}_{i,q}$ and $\hat{s}_{i,q+1}$ represent q-th and (q+1)-th recommended position values on a recommended driving curve of the i-th train unit, respectively, $\hat{v}_{i,q}$ and $\hat{v}_{i,q+1}$ represent q-th and (q+1)-th recommended speed values on the recommended driving curve of the i-th train unit, respectively, and I is a number of train units in the VCTS;

calculating, based on the initial target position and the initial target speed, a target position and a target speed in the target state sequence for the current cycle of each train unit based on following formulas:

$$\bar{s}_{i,j+1|k} = \bar{s}_{i,j|k} + \tau \bar{v}_{i,j|k},\ j = 0, 1, \ldots, N-1$$

$$\bar{v}_{i,j+1|k} = V(\bar{s}_{i,j+1|k})$$

wherein $\bar{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, N is a number of target states in the target state sequence, $\tau$ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{ip})}{\hat{s}_{i,p+1} - \hat{s}_{i,p}}, \text{ s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively;

performing differential calculation on the target speed in the target state sequence for the current cycle of each train unit to obtain a target acceleration in the target state sequence for the current cycle of each train unit.

19. The electronic device according to claim 15, wherein the calculating the target state sequence for the current cycle of each train unit by using a synchronization relationship according to the actual state for the current cycle of each train unit comprises:

determining, according to an actual position and an actual speed for the current cycle of each train unit, an initial target state of each train unit as:

$$\bar{s}_{i,0|k} = s_{i,k},\ \bar{v}_{1,0|k} = V(\bar{s}_{1,0|k}),\ \bar{v}_{i',0|k} = V(\bar{s}_{i',0|k}) + v_a(0),\ i' = 2, 3, \ldots, I;$$

wherein $\bar{s}_{i,0|k}$ is an initial target position in a target state sequence for the current cycle of the i-th train unit, $s_{i,k}$ is an actual position for the current cycle of the i-th train unit, $\bar{v}_{1,0|k}$ and $\bar{v}_{i',0|k}$ are initial target speeds in target state sequences for the current cycle of the first train unit and a i'-th train unit, respectively, $v_a(0)$ is an adjustment amount of the initial target speed in the target state sequence for the current cycle of the i-th train unit, V( ) is a calculation function of a target speed, $$V(\bar{s}_{i,0|k}) = \hat{v}_{i,q} + \frac{(\bar{s}_{i,0|k} - \hat{s}_{i,q})(\hat{v}_{i,q+1} - \hat{v}_{i,q})}{\hat{s}_{i,+1} - \hat{s}_{i,q}}, \text{ s.t. } \hat{s}_{i,q} \le \bar{s}_{i,0|k} < \hat{s}_{i,q+1},$$

$\hat{s}_{i,q}$ and $\hat{s}_{i,q+1}$ represent q-th and (q+1)-th recommended position values on the recommended driving curve of the i-th train unit, respectively, $\hat{v}_{i,q}$ and $\hat{v}_{i,q+1}$ represent q-th and (q+1)-th recommended speed values on the recommended driving curve of the i-th train unit, respectively, and I is a number of train units;

calculating, based on the initial target state, a target position and a target speed in the target state sequence for the current cycle of each train unit based on following formulas:

$$\bar{s}_{i,j+1|k} = \bar{s}_{i,j|k} + \tau \bar{v}_{i,j|k},\ j = 0, 1, \ldots, N-1$$

$$\bar{v}_{i,j+1|k} = V(\bar{s}_{i,j+1|k}) + v_a(j)$$

wherein $\bar{s}_{i,j+1|k}$ and $\bar{v}_{i,j+1|k}$ are a (j+1)-th target position and a (j+1)-th target speed in the target state sequence for the current cycle of the i-th train unit, respectively, $\bar{s}_{i,j|k}$ and $\bar{v}_{i,j|k}$ are a j-th target position and a j-th target speed in the target state sequence for the current cycle of the i-th train unit, respectively, $\tau$ is a sampling interval time, V( ) is a calculation function of the target speed, $$V(\bar{s}_{i,j+1|k}) = \hat{v}_{i,p} + \frac{(\bar{s}_{i,j+1|k} - \hat{s}_{i,p})(\hat{v}_{i,p+1} - \hat{v}_{i,p})}{\hat{s}_{i,p+1} - \hat{s}_{i,p}}, \text{ s.t. } \hat{s}_{i,p} \le \bar{s}_{i,j+1|k} < \hat{s}_{i,p+1},$$

$\hat{s}_{i,p}$ and $\hat{s}_{i,p+1}$ represent p-th and (p+1)-th recommended position values on the recommended driving curve of the i-th train unit, respectively, $\hat{v}_{i,p}$ and $\hat{v}_{i,p+1}$ represent p-th and (p+1)-th recommended speed values on the recommended driving curve of the i-th train unit, respectively, and $v_a(j)$ is an adjustment amount of the j-th target speed in the target state sequence;

performing differential calculation on the target speed in the target state sequence for the current cycle of each train unit to obtain a target acceleration in the target state sequence for the current cycle of each train unit.

20. A computer-readable storage medium storing a computer program, wherein the computer program, when executed, implements the method according to claim 1.

* * * * *